US008353455B1

(12) United States Patent
Huang

(10) Patent No.: US 8,353,455 B1
(45) Date of Patent: Jan. 15, 2013

(54) ELECTRONIC DEVICE ADAPTED FOR USE AS A SHOOTING SIGHT

(76) Inventor: Dorge O. Huang, Henry, IL (US)

( * ) Notice: Subject to any disclaimer, the term of this patent is extended or adjusted under 35 U.S.C. 154(b) by 0 days.

(21) Appl. No.: 13/223,749

(22) Filed: Sep. 1, 2011

(51) Int. Cl.
*G06F 19/00* (2011.01)

(52) U.S. Cl. ..... 235/404; 235/400

(58) Field of Classification Search ..... 235/400–418; 356/3–22

See application file for complete search history.

(56) References Cited

U.S. PATENT DOCUMENTS

| | | | | |
|---|---|---|---|---|
| 6,449,419 | B1 * | 9/2002 | Brough et al. | 385/136 |
| 7,255,035 | B2 * | 8/2007 | Mowers | 89/41.05 |
| 2007/0199226 | A1 * | 8/2007 | Handel | 42/118 |
| 2010/0115778 | A1 * | 5/2010 | Gorsuch et al. | 33/265 |
| 2012/0046100 | A1 * | 2/2012 | Roman et al. | 463/30 |

* cited by examiner

*Primary Examiner* — Michael G Lee
*Assistant Examiner* — Matthew Mikels
(74) *Attorney, Agent, or Firm* — Donald J. Ersler

(57) ABSTRACT

An electronic device adapted for use as a shooting sight preferably includes an electronic device and an application software program. The electronic device includes a microprocessor, operating system software a and a flat screen display. The application software program is installed in the microprocessor. The application software program communicates with the operating system. The application software program includes sight indicia, a weapon profile input, a laser finder input and operation display tabs. The sight indicia overlays a video image on the flat screen display. The operation display tabs are displayed on the flat screen display in addition to the sight indicia. The type, position, color and size of the sight indicia is set by clicking on operation display tabs. A retention bracket holds the electronic device and is secured to a weapon. The sight indicia is aligned with an image seen on the flat screen display.

20 Claims, 8 Drawing Sheets

ELECTRONIC DEVICE ADAPTED FOR USE AS A SHOOTING SIGHT

BACKGROUND OF THE INVENTION

1. Field of the Invention

The present invention relates generally to shooting sights and more specifically to an electronic device adapted for use as a shooting sight, which provides an improved shooting sight for archery devices, firearms and any other weapon.

2. Discussion of the Prior Art

There are numerous types of shooting sights in the art for various types of weapons. However, it appears the art does not disclose an electronic device adapted for use as a shooting sight.

Accordingly, there is a clearly felt need in the art for an electronic device adapted for use as a shooting sight, which provides an improved shooting sight for bows, cross bows, firearms and any other weapon and allows a hunt to be recorded without the need for an eye wear camera or a sport video camera.

SUMMARY OF THE INVENTION

The present invention provides an electronic device adapted for use as a shooting sight, which allows a hunt to be recorded without the need for an eye wear camera or a sport video camera. The electronic device adapted for use as a shooting sight (electronic device shooting sight) preferably includes an electronic device and an application software program. The electronic device may be an iPhone, an iPod with camera, an Android or any other suitable device. The electronic device includes a microprocessor, operating system software, a camera lens, a video processor, a flat screen display, a display driver and memory. The operating system is installed in the microprocessor. The camera lens receives an image and the video processor converts the image into an electrical video signal. The electrical video signal is then fed to the display driver. The display driver converts the electrical video signal into a format for display on the flat screen display. The video processor preferably includes a signal processor to do further processing, if needed for night vision or thermo-sensing in an infra-red spectrum.

The application software program is installed in the microprocessor. The application software program communicates with the operating system. The application software program includes sight indicia, a weapon profile input, a laser finder input and operation display tabs. The sight indicia can be in any suitable form, such as a vertical line of circles. The sight indicia is preferably similar to a plurality of pins on a pin sight. The application software sends the sight indicia in an electronic form to the display driver. The sight indicia overlays the video image. The operation display tabs are displayed on the flat screen display in addition to the sight indicia. The operation display tabs preferably include a stop tab, a settings tab, indicia position arrows, indicia type tabs and indicia size arrows. The settings tab is pressed to record an image of the area for shooting. The memory of the electronic device allows some portion of the hunt to be recorded for future viewing as a movie. The sight indicia is coordinated with the image shown on the flat screen display by providing the weapon profile and distance to each sight indicia with a range finder. The type of weapon and the ammunition is entered into weapon profile input, such as the model of a bow and a type of arrow. The type of weapon and the ammunition provide trajectory and speed information for use in setting the position and size of the sight indicia.

The range finder is connected to an input of the electronic device to define a distance of the sight indicia. When the weapon profile and the trajectory information is obtained, the position, size and color of the sight indicia may be set. The position and size of the sight indicia is set by clicking the settings tab, until a select object screen is displayed. The user points to a particular indicia to be set. An adjustment screen is then displayed to allow the size and position of the selected indicia to be set through the indicia size arrows and indicia position arrows. The indicia type tabs allows the type of indicia to be selected.

An electronic device retention bracket preferably includes a first retainer half, a second retainer half, a reduction lens and a snap clip. The first retainer half includes a first side wall and a T-projection. The second retainer half includes a second side wall and a plurality of alignment projections. The reduction lens is retained in a rear of the first retainer half. The electronic device is retained between the first and second retainer halves. The snap clip holds the first and second retainer halves together.

Accordingly, it is an object of the present invention to provide an electronic device shooting sight, which provides an improved shooting sight for bows, cross bows, firearms and any other weapon.

Finally, it is another object of the present invention to provide an electronic device shooting sight, which allows a hunt to be recorded without the need for an eye wear camera or a sport video camera.

These and additional objects, advantages, features and benefits of the present invention will become apparent from the following specification.

DETAILED DESCRIPTION OF THE PREFERRED EMBODIMENTS

Figure 1:
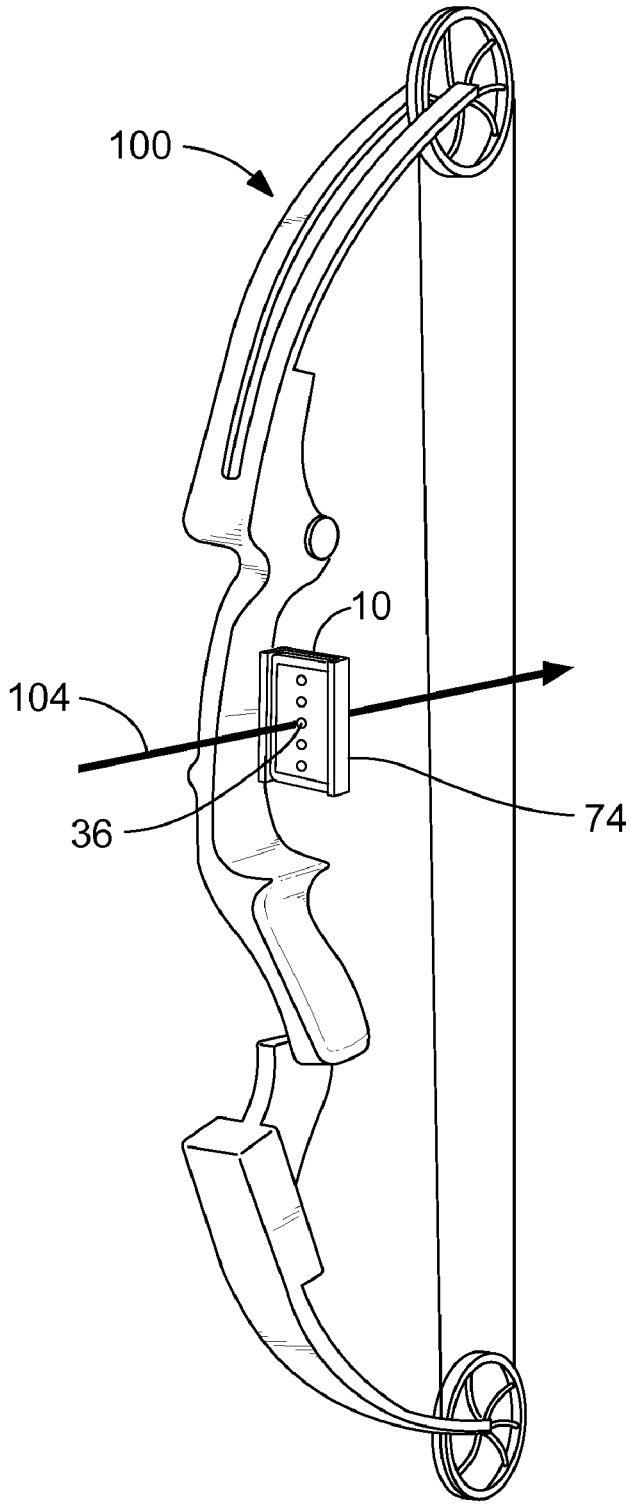
FIG. 1 is a perspective view of an electronic device shooting sight mounted to a compound bow in accordance with the present invention.
Figure 2:
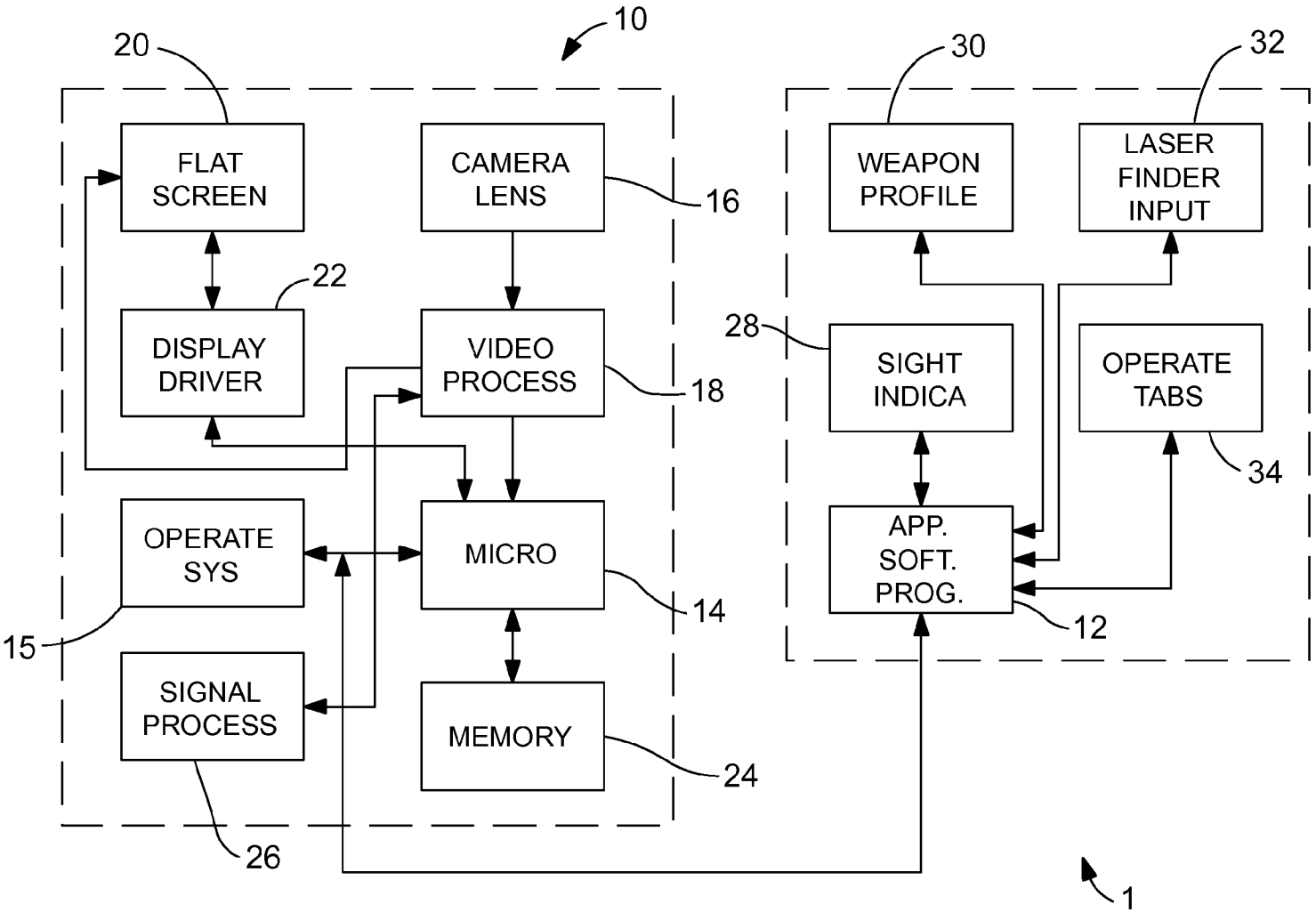
FIG. 2 is a schematic diagram of an electronic device shooting sight in accordance with the present invention.

With reference now to the drawings, and particularly to FIG. 1, there is shown a perspective view of an electronic device shooting sight 1 retained on a compound bow 100. With reference to FIG. 2, the electronic device shooting sight 1 preferably includes an electronic device 10 and an application software program 12. The electronic device 10 may be an iPhone, an iPod with a camera, an Android or any other suitable device. The electronic device 10 includes a microprocessor 14, operating system software 15, a camera lens 16, a video processor 18, a flat screen display 20, a display driver 22 and memory 24. The operating system 15 is installed in the microprocessor 14. The camera lens 16 receives an image of a targeted area. The video processor 18 converts the image of the targeted area into an electrical video signal. The electrical video signal is then fed to the display driver 22. The display driver 22 converts the electrical video signal into an electrical format for display on the flat screen display 20. The video processor 18 preferably includes a signal processor 26 to do further processing, if needed for night vision or thermo sensing in an infra-red spectrum.

Figure 3:
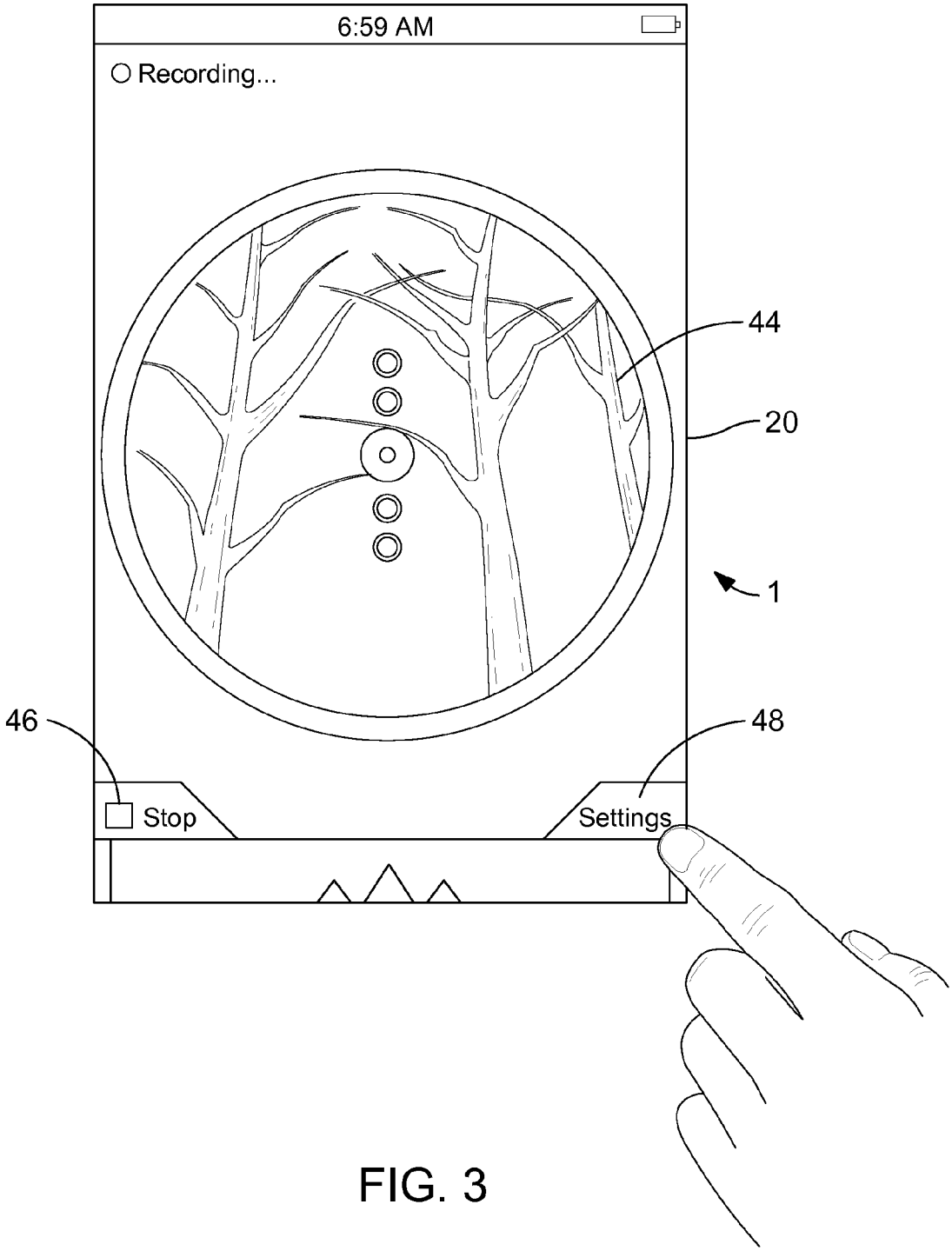
FIG. 3 is a front view of an electronic device shooting sight with an application software program in operation to video record an area for hunting in accordance with the present invention.
Figure 4:
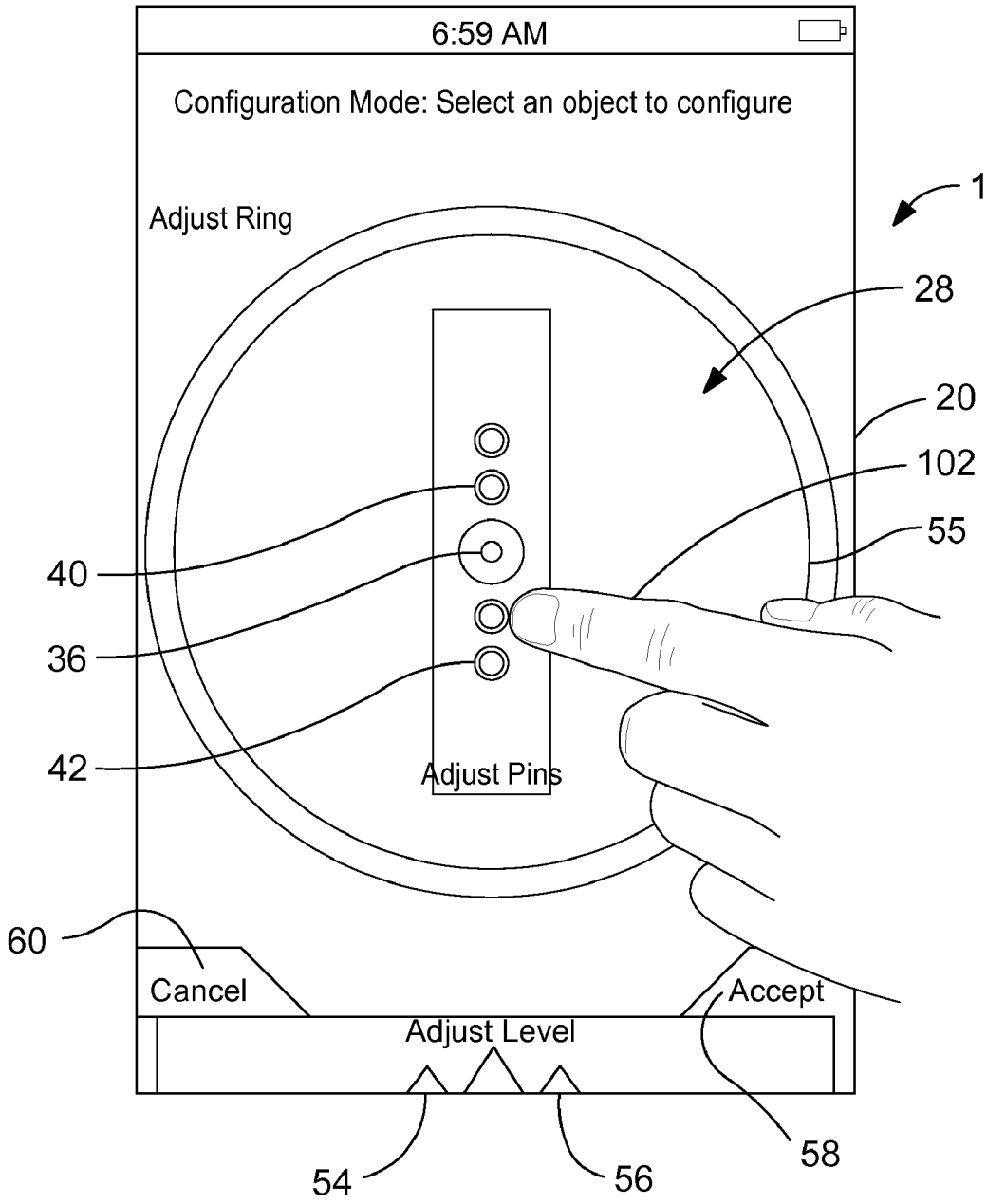
FIG. 4 is a front view of an electronic device shooting sight with an application software program in a configuration mode for setting sight indicia in accordance with the present invention.

The application software program 12 is installed in the microprocessor 14. The application software program 12 communicates with the operating system 15. The application software program 12 includes sight indicia 28, a weapon profile input 30, a laser finder input 32 and operation display tabs 34. The sight indicia 28 can be in any suitable form, such as a vertical line of circles, but other appropriate sight indicia may also be used. With reference to FIG. 4, the sight indicia 28 preferably includes a center pin with concentric ring 36, at least one top ring 40 and at least one bottom ring 42. The center pin with concentric ring 36, the at least one top ring 40 and the at least one bottom ring 42 are similar to a plurality of pins on a pin sight. The application software 12 sends the sight indicia 28 in an electronic form to the display driver 22. With reference to FIG. 3, the sight indicia 28 overlays a video image 44.

Figure 5:
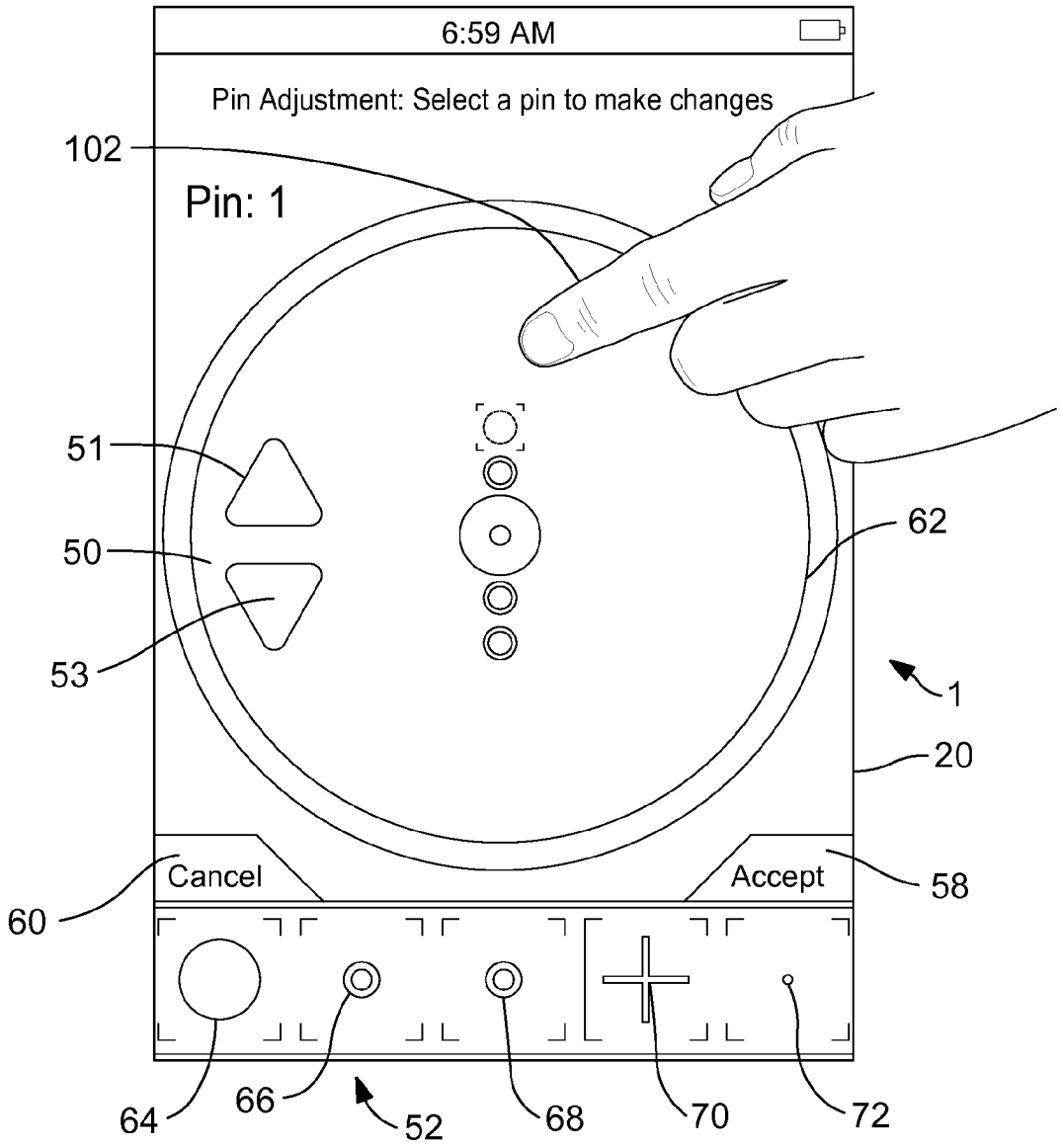
FIG. 5 is a front view of an electronic device shooting sight with an application software program in a pin adjustment mode for setting the distance of sight indicia in accordance with the present invention.

The operation display tabs 34 are displayed on the flat screen display 20 in addition to the sight indicia 28. With reference to FIG. 5, the operation display tabs 34 include a stop tab 46, a settings tab 48, indicia position arrows 50, indicia type tabs 52 and indicia size arrows 54, 56. The settings tab 48 is pressed to record an image of the targeted area for shooting. The memory 24 of the electronic device 10 allows some portion of the hunt to be recorded for future viewing as a movie. The sight indicia 28 is coordinated with the video image 44 shown on the flat screen display 20 by providing the weapon profile and distance to each sight indicia 36, 40, 42 with a range finder (not shown). The type of weapon and the ammunition is entered into the weapon profile input 30, such as the model of a bow and a type of arrow. The type of weapon and the ammunition provide trajectory and speed information is used for setting the position and size of the sight indicia 28.

The range finder is connected to an input of the electronic device 10 to define a distance of the sight indicia 28. When the weapon profile and the trajectory information is obtained, the type, position, size and color of the sight indicia 28 may be set. To set the size of the sight indicia 28, the settings tab 48 is pressed, until a select object screen 55 is displayed. The size of each size indicia 36, 40, 42 is set by pointing thereto with a finger 102 and also clicking a decrease size indicia size arrow 54 or an increase size indicia size arrow 56. Once the size of the indicia 36, 40, 42 is set; an accept tab 58 is pressed. To cancel adjusting the size of one of the sight indicia 28, a cancel tab 60 is pressed.

The position, type and color of the sight indicia 28 is set by clicking the settings tab 48, until an adjustment screen 62 is displayed. The position of each sight indicia 36, 40, 42 is set by pointing with the finger 102 and clicking the indicia position arrows 50. A top arrow 51 moves the sight indicia 36, 40, 42 upward and a bottom arrow 53 moves the sight indicia 36, 40, 42 downward. The type and color of the sight 28 is chosen by clicking on a plurality of indicia tabs 64, 66, 68, 70, 72. The indicia tab 64 offers a red pin with a concentric ring; the indicia tab 66 offers a yellow ring; the indicia tab 68 offers a green ring; the indicia tab 70 offers a cross hair; and the indicia tab 72 offers a pin.

Figure 6:
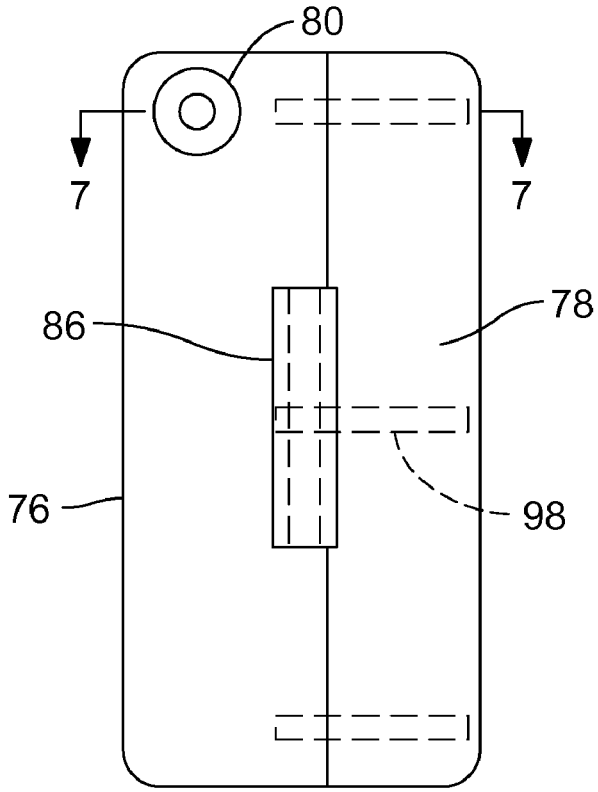
FIG. 6 is a rear view of an electronic device retention bracket with a reduction lens for providing a 1:1 magnification of an electronic device shooting sight in accordance with the present invention.
Figure 7:
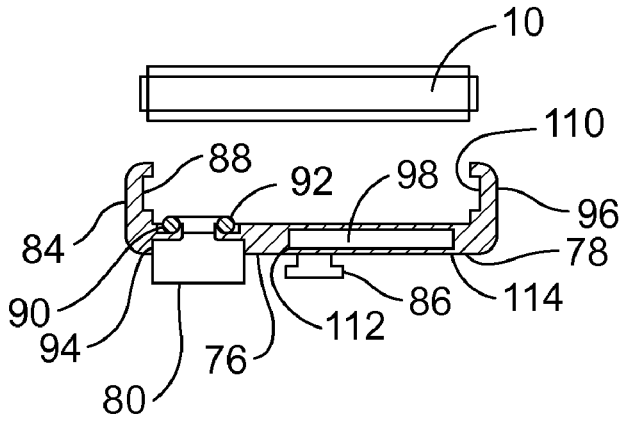
FIG. 7 is a top cross sectional view cut through FIG. 6 of an electronic device retention bracket with an electronic device adjacent thereto of an electronic device shooting sight in accordance with the present invention.
Figure 8:
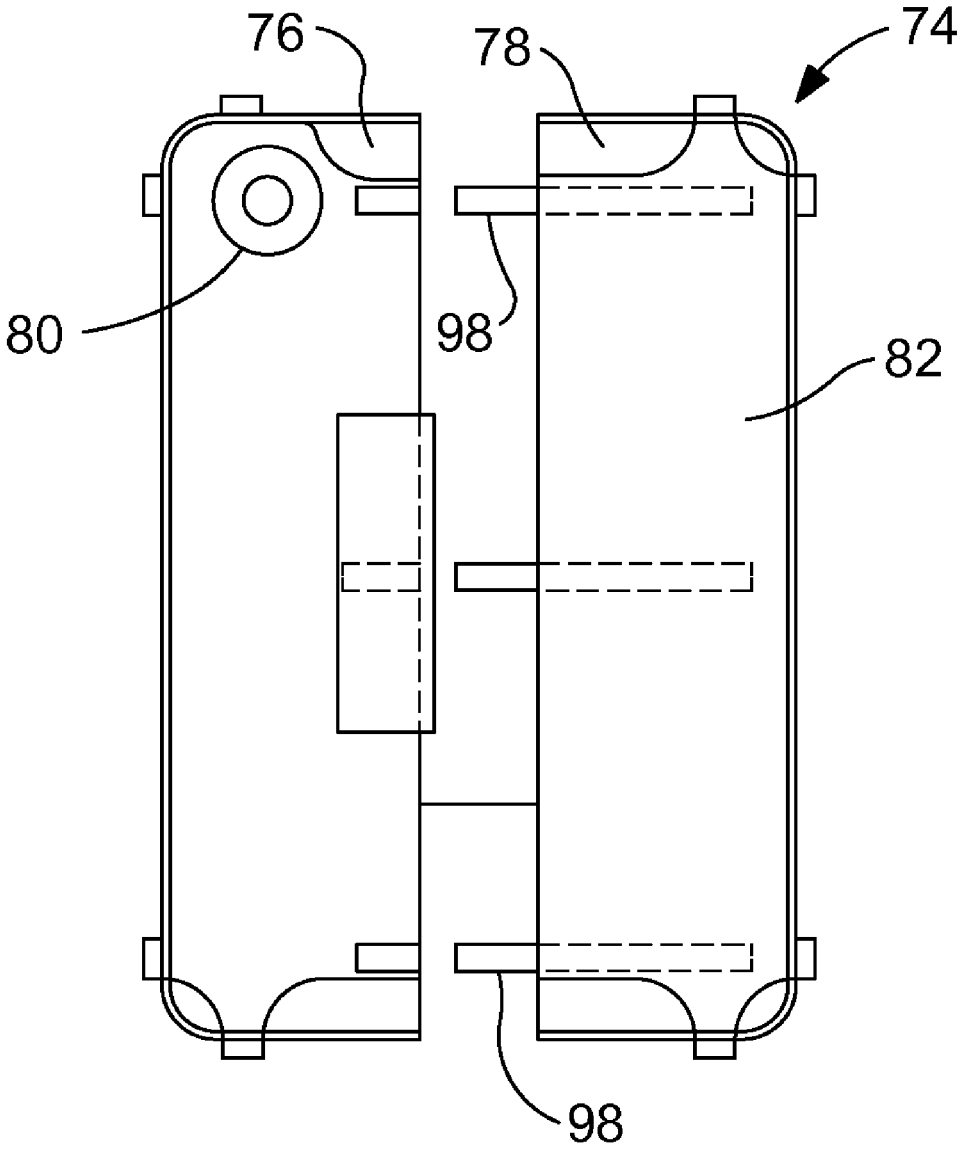
FIG. 8 is an exploded rear view of an electronic device retention bracket of an electronic device shooting sight in accordance with the present invention.

With reference to FIGS. 6-8, an electronic device retention bracket 74 preferably includes a first retainer half 76, a second retainer half 78, a reduction lens 80 and a snap clip 82. The first retainer half 76 includes a first side wall 84 and a T-projection 86. The first side wall 84 extends from one end of the first retainer half 76 and the T-projection 86 extends from the other end of the first retainer half 76. A first side slot 88 is formed on an inside surface of the first side wall 84 to receive a first side of the electronic device 10. An o-ring groove 90 is formed on an inside surface of the first retainer half 76 to retain an o-ring 92. The o-ring 92 seals the lens of the electronic device 10 to the first retainer half 76. A lens bore 94 is formed in a rear of the first retainer half 76 to retain the reduction lens 80. The reduction lens 80 reduces the magnification of the electronic device 10 to a 1× magnification.

Figure 9:
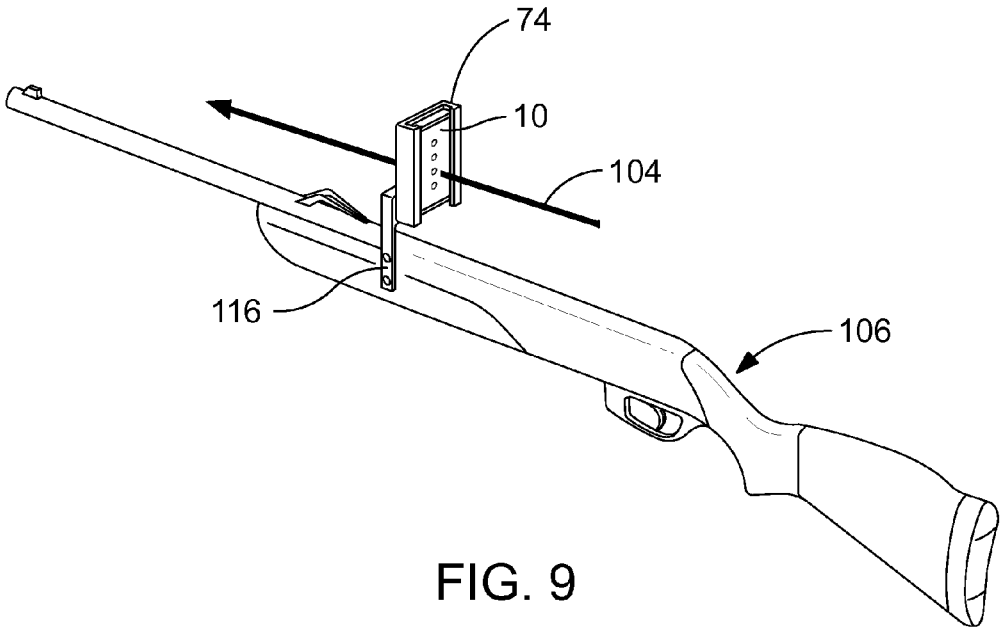
FIG. 9 is a perspective view of an electronic device shooting sight mounted to a rifle in accordance with the present invention.

The second retainer half 78 includes a second side wall 96 and a plurality of alignment projections 98. The second side wall 96 extends from one end of the second retainer half 78. A second side slot 110 is formed on an inside surface of the second side wall 98 to receive a second side of the electronic device 10. A plurality of first projection pockets 112 are formed in the other end of the first retainer half 76 to slidably receive the plurality of alignment projections 98. The plurality of alignment projections 98 are retained in second projection pockets 112 formed in the other end of the second retainer half 78. The electronic device 10 is retained in the first and second side slots. The snap clip 82 holds the first and second retainer halves together. The snap clip 82 can be of any suitable design. With reference to FIG. 9, an attachment bracket 116 is used to retain the T-projection and provide attachment to a weapon.

Figure 10:
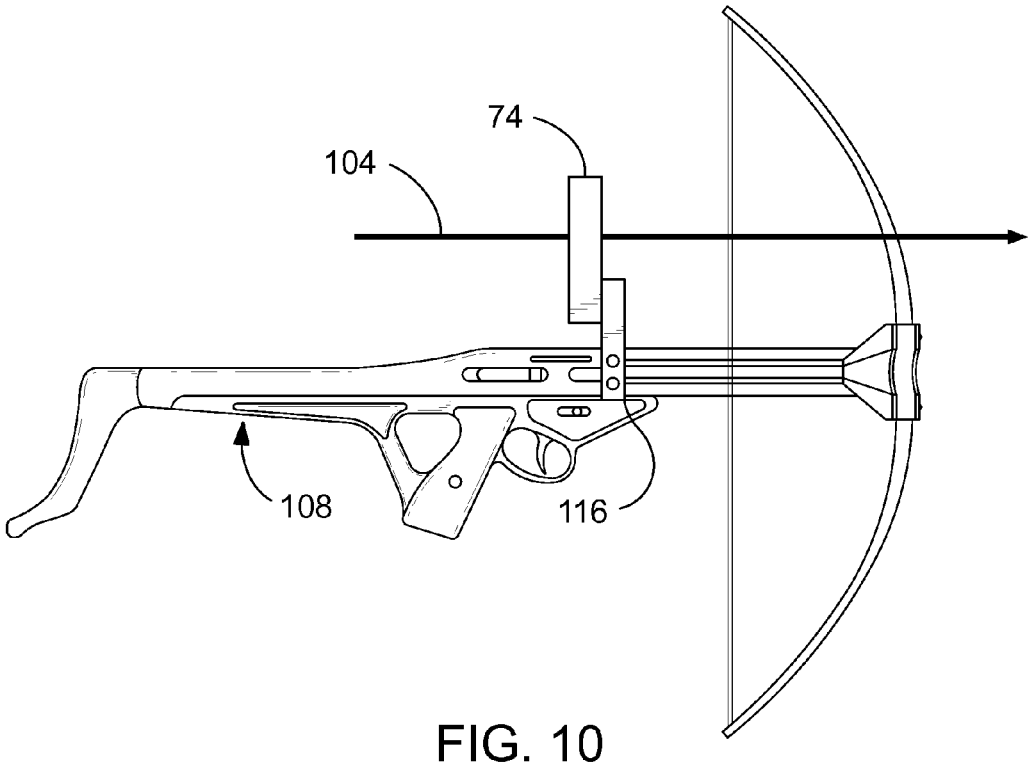
FIG. 10 is a perspective view of an electronic device shooting sight mounted to a crossbow in accordance with the present invention.

With reference to FIG. 1, the retention bracket 74 is retained on the compound bow sight 100, where a sight is usually attached. The electronic device retention bracket 74 should not be limited to any particular design. A user aligns an arrow 104 on the compound bow 100 along a line of sight 104 using the center pin with concentric ring 36. With reference to FIG. 9, the electronic device 10 is attached to a rifle 106 with the electronic device retention bracket 74 and the attachment bracket 116. The attachment bracket 116 is well known in the art and may be purchased from numerous manufacturers. With reference to FIG. 10, the electronic device 10 is attached to a crossbow 108 with the retention bracket 74 and the attachment bracket 116.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A shooting sight application software program for installation on an electronic device comprising:

a shooting sight application software program is installed on an electronic device, the electronic device includes a camera; and at least one electronically generated sight indicia is generated by said shooting sight application software program, said at least one electronically generated sight indicia is overlaid on an image from said camera, the image is shown on a video display screen of the electronic device.

2. The shooting sight application software program for installation on an electronic device of claim 1 wherein:

said application software program utilizes memory of the electronic device to record a portion of a hunt for future viewing as a movie.

3. The shooting sight application software program for installation on an electronic device of claim 1 wherein:

said application software program utilizes a video processor of the electronic device for night vision or thermosensing in an infra-red spectrum.

4. The shooting sight application software program for installation on an electronic device of claim 1 wherein:

said at least one electronically generated sight indicia includes a center pin with concentric ring, at least one top ring and at least one bottom ring.

5. The shooting sight application software program for installation on an electronic device of claim 4 wherein:

the size of said at least one electronically generated sight indicia is set by pointing to each one of said at least one electronically generated sight indicia with a finger and contacting indicia size arrows displayed on the display screen.

6. The shooting sight application software program for installation on an electronic device of claim 4 wherein:

the position of said at least one electronically generated sight indicia is set by pointing to each one of said at least one electronically generated sight indicia with a finger and contacting indicia position arrows displayed on the display screen.

7. The shooting sight application software program for installation on an electronic device of claim 1 wherein:

a type of sight indicia of said at least one electronically generated sight indicia is set by contacting one of a plurality of indicia type tabs displayed on the video display screen.

8. The shooting sight application software program for installation on an electronic device of claim 1 wherein:

said shooting sight application software program includes a range finder input to define a distance of said at least one electronically generated sight indicia.

9. An electronic device mounted to a weapon for use as a shooting sight comprising:

an electronic device is secured to a weapon, the electronic device includes a camera; and an application software program is installed on the electronic device, said application software program includes at least one electronically generated sight indicia said at least one electronically generated sight indicia is overlaid on an image from said camera, the image is shown on a video display screen of the electronic device, said at least one electronically generated sight indicia is set to a specific distance.

10. The electronic device mounted to a weapon for use as a shooting sight of claim 9, further comprising:

a retention bracket retains said electronic device, said retention bracket is secured to the weapon.

11. The electronic device mounted to a weapon for use as a shooting sight of claim 1 wherein:

said shooting sight application software program includes a range finder input to define the distance of said at least one electronically generated sight indicia.

12. The electronic device mounted to a weapon for use as a shooting sight of claim 9 wherein:

said shooting sight application software program includes a weapon profile input for entry of trajectory information concerning a weapon and ammunition of the weapon.

13. A shooting sight application software program for installation on an electronic device comprising:

a shooting sight application software program is installed on an electronic device, the electronic device includes a camera, the camera includes a video processor, wherein the video processor converts an image into an electrical video signal; and at least one electronically generated sight indicia is generated by said shooting sight application software program, the electrical video signal is feed into a video display screen of the electronic device to display a video image, said at least one electronically generated sight indicia is overlaid on the video image, the video image and said at least one electronically generated sight indicia are shown on the video display screen.

14. The shooting sight application software program for installation on an electronic device of claim 13 wherein:

said shooting sight application software program includes a weapon profile input for entry of trajectory information concerning a weapon and ammunition of the weapon, the weapon and ammunition trajectory information is used to set the position and size of the at least one electronically generated sight indicia, wherein the electronic device is secured to a weapon to act as a shooting sight.

15. The shooting sight application software program for installation on an electronic device of claim 13 wherein:

said application software program utilizes memory of the electronic device to record a portion of a hunt for future viewing as a movie.

16. The shooting sight application software program for installation on an electronic device of claim 13 wherein:

said application software program utilizes a video processor of the electronic device for night vision or thermosensing in an infra-red spectrum.

17. The shooting sight application software program for installation on an electronic device of claim 13 wherein:

said at least one electronically generated sight indicia includes a center pin with concentric ring, at least one top ring and at least one bottom ring.

18. The shooting sight application software program for installation on an electronic device of claim 17 wherein:

the size of said at least one electronically generated sight indicia is set by pointing to each one of said at least one electronically generated sight indicia with a finger and contacting indicia size arrows displayed on the display screen.

19. The shooting sight application software program for installation on an electronic device of claim 17 wherein:

the position of said at least one electronically generated sight indicia is set by pointing to each one of said at least one electronically generated sight indicia with a finger and contacting indicia position arrows displayed on the display screen.

20. The shooting sight application software program for installation on an electronic device of claim 13 wherein:

at least one operation display tab for setting a position and size of said at least one electronically generated sight indicia.

* * * * *